US005297881A

United States Patent [19]

Ishiyama

[11] Patent Number: 5,297,881

[45] Date of Patent: Mar. 29, 1994

[54] PRINTING MACHINE CARRIAGE HAVING A MAGNETIC ENCODER

[75] Inventor: Noritaka Ishiyama, Kawasaki, Japan

[73] Assignee: Mitsubishi Steel Mfg. Co., Ltd., Tokyo, Japan

[21] Appl. No.: 995,545

[22] Filed: Dec. 22, 1992

Related U.S. Application Data

[63] Continuation-in-part of Ser. No. 874,804, Apr. 28, 1992, abandoned.

[30] Foreign Application Priority Data

May 16, 1991 [JP] Japan ..... 3-139413

[51] Int. Cl.[5] ..... B41J 19/00

[52] U.S. Cl. ..... 400/705; 400/705.1; 400/322

[58] Field of Search ..... 400/322, 320, 705, 705.1, 400/708, 279

[56] References Cited

U.S. PATENT DOCUMENTS

| | | | |
|---|---|---|---|
| 3,735,231 | 5/1973 | Sawyer | 318/687 |
| 4,180,338 | 12/1979 | Lemanna et al. | 400/130 |
| 4,294,121 | 10/1981 | Inoue | 73/662 |
| 4,359,289 | 11/1982 | Barrus et al. | 400/322 |
| 4,408,906 | 10/1983 | Wallace | 400/104 |
| 4,962,876 | 10/1990 | Andou et al. | 400/124 |
| 4,969,760 | 11/1990 | Lemanna et al. | 400/134 |
| 5,024,542 | 6/1991 | Tanaka | 101/93.05 |
| 5,075,609 | 12/1991 | Ito et al. | 400/322 |

FOREIGN PATENT DOCUMENTS

| | | |
|---|---|---|
| 57-95687 | 6/1982 | Japan . |
| 61-39592 | 2/1986 | Japan . |
| 1-184885 | 7/1989 | Japan . |
| 2-4560 | 1/1990 | Japan . |
| 4-86577 | 3/1992 | Japan . |

*Primary Examiner*—Edgar S. Burr
*Assistant Examiner*—John S. Hilten
*Attorney, Agent, or Firm*—Frishauf, Holtz, Goodman & Woodward

[57] ABSTRACT

A printing machine for printing at printing positions along a line, and for performing a positional control by linear encoder. The printing machine comprises a linear encoder memory and detecting means. The linear encoder memory has a line-shaped magnetic recording medium formed of an alloy consisting essentially of iron, chromium, cobalt, no more than 0.03 weight % of carbon, and optionally 0.05 to 3 weight % of at least one element selected from the group consisting of titanium, vanadium, molybdenum and tungsten. The linear encoder memory extends parallel along a line of printing positions. The detecting means is coupled to the magnetic recording medium and is movable relative to the magnetic recording medium. The decting means detects a magnetic record on the magnetic recording medium. The detecting means comprises a magnetic head which includes a magnetic sensor element and a supporting mount. The supporting mount is disposed opposite the magnetic sensor element and is in contact with the magnetic sensor element. The supporting mount and magnetic sensor element together forming means for surrounding the line-shaped magnetic recording medium and for transversely and slidably receiving the line-shaped magnetic recording medium between the supporting mount and the magnetic sensor element.

16 Claims, 3 Drawing Sheets

PRINTING MACHINE CARRIAGE HAVING A MAGNETIC ENCODER

This application is a continuation-in-part application of application Ser. No. 07/874,804, filed Apr. 28, 1992, now abandoned.

BACKGROUND OF THE INVENTION

1. Field of the Invention

The present invention relates to a printing machine for a printer using a magnetic linear encoder.

2. Background Information

In a conventional printer printing machine, there has been used an optical system having a scale in which an optical sensor and a slit band are combined as a linear encoder. In the optical linear encoder, the scale must be made with high precision in order to improve resolving power. Due to this, the manufacturing cost increases. Moreover, if dirt and dust of a printer ink are adhered to the surface of the scale, light is not easily transmitted, and an erroneous measured value of the linear encoder is obtained. Therefore, this causes erroneous operation and trouble of the printer printing machine.

SUMMARY OF THE INVENTION

An object of the present invention is to provide a printer printing machine having high reliability even under an environment in which the machine is easily contaminated.

In order to attain the above object, the printer printing machine of the present invention, which controls the position by use of the linear encoder, uses a high resolving magnetic recording medium, which is formed of an alloy containing iron, chrome and cobalt (hereinafter simply called as an alloy), as a memory of the linear encoder, and detects the magnetic record by a magnetic head.

The composition of the alloy can be freely set in accordance with a requested magnetic characteristics. It is preferable that the composition of the alloy consist of chrome (hereinafter when "chrome" is recited it is understood that "chrome" means "chromium"): 13 to 32%, cobalt: 5 to 20%, and iron: residue, by weight % (herein all percentages are present by weight). The alloy contains substantially no carbon, i.e., not more than 0.03% carbon, for example, 0.005 to 0.03% carbon. In particular, it is preferable that the composition of the alloy consist of chrome: 16 to 25%, cobalt: 7 to 16%, and iron: residue. Moreover, in order to improve machinability and a magnetic characteristic, 0.05 to 3% of each of titanium, vanadium, molybdenum, and tungsten may be added.

It is general that the magnetic recording medium is long-shaped such as a wire or a band.

It is preferable to make the shape of the cross section of the magnetic recording medium circular since an oil impregnated bearing can be used as a sliding mechanism of the magnetic head and a gap between the magnetic recording medium and the magnetic detecting head can be easily held constant.

The following meaning is found in that the cross section of the recording medium is formed such that a magnetic recording surface and a bottom surface thereof are parallel to each other.

The detecting head must be precisely moved to be parallel to the recording medium. If the magnetic recording surface is parallel to the bottom surface, the bottom surface which act as a fixing surface of the recording medium and the parallel movement mechanism are easily adjusted, thereby the recording surface and the detecting head can be automatically moved parallel to each other with precision. By use of the above-mentioned structure, assembly can be made easy.

The present invention also concerns a printing machine for printing at positions along a line, and for performing a positional control by a linear encoder. The printing machine comprising:

a linear encoding memory having a line-shaped magnetic recording medium formed of an alloy containing iron, chromium and cobalt, no more than 0.03 weight % of carbon, and optionally 0.05 to 3 weight % of one or more elements selected from the group consisting of titanium, vanadium, molybdenum and tungsten, the memory extending parallel along a line of printing positions; and a magnetic head for detecting a magnetic record on the magnetic record medium, the magnetic head comprising a magnetic sensor element and a supporting mount, the supporting mount being disposed opposite the magnetic sensor element and in contact with the magnetic sensor element so as to transversely and slidably receive the line-shaped magnetic recording medium therebetween and to completely surround the line-shaped magnetic recording medium.

The line-shaped magnetic recording medium preferably comprises a member having a circular or a truncated circular cross section. The magnetic head to be used in the printer printing machine of the present invention may be a well known magnetic sensor of magneto-resistance effect type. It is preferably possible to use a magnetic sensor of magneto-resistance effect type, which can obtain an effective output even in a high temperature atmosphere as disclosed in patent application No. Hei 2-199123, which is incorporated by reference.

As a mounting mechanism of the magnetic head, it is preferable to use a mechanism in which the magnetic head is formed in a gap holding part, which is movably fitted to the long magnetic recording medium, and the gap holding part moves along the long magnetic recording medium.

Also, the gap holding part and the long magnetic recording medium may be relatively moved. In other words, the long magnetic recording medium may be movable.

BRIEF DESCRIPTION OF THE DRAWINGS

The embodiments of the printer printing machine of the present invention will be explained with reference to the drawings.

DESCRIPTION OF THE PREFERRED EMBODIMENTS

Figure 1:
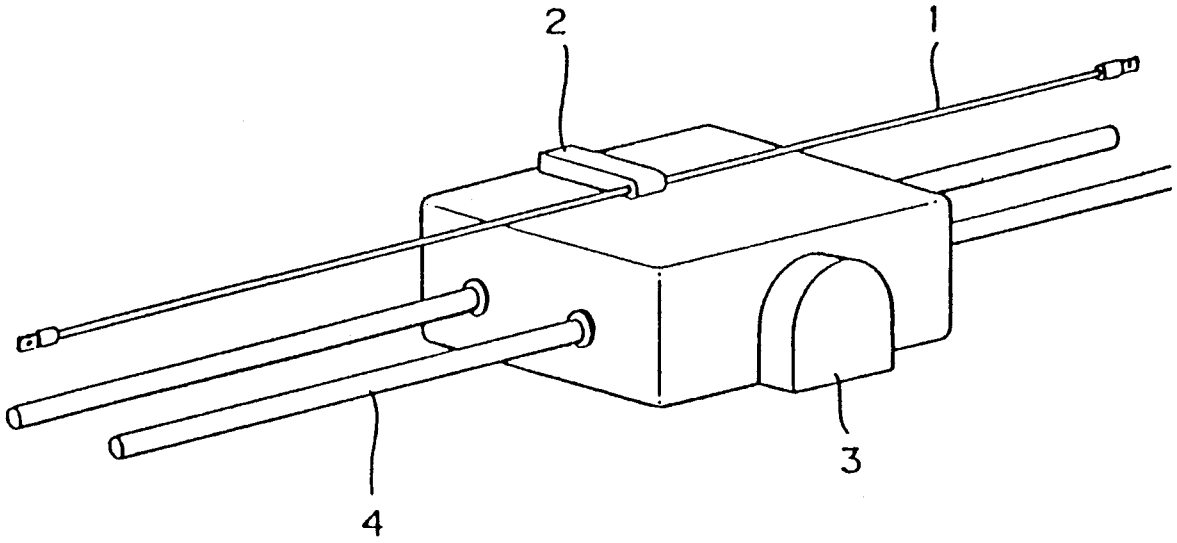
FIG. 1 is a perspective view of an embodiment of the present invention.

An alloy containing iron, chromium and cobalt represents a magnetic material by separating the single $\alpha$ phase of a ferromagnetic material into two phases, namely the $\alpha_1$-phase and the $\alpha_2$-phase. However, a harmful $\gamma$-phase deposition occurs at the high temperature region during the cooling of this alloy from the melting point temperature to the normal temperature.

Since carbon hastens the deposition of the γ-phase, the carbon content has to be decreased to be as low as possible.

An alloy of Fe-Cr-Co necessarily contains at least 0.005% of carbon; such carbon being introduced from the raw materials.

The coercive force of the alloy for use in the present invention decreases at the 0.03 maximum % of carbon content, since increased carbon content will cause a significant production of said harmful γ-phase. Thus 0.03% carbon defines the upper limit of carbon to be contained in this alloy with a preferred carbon range of no more than 0.02%.

Excellent magnetic characteristics, i.e., a coercive force of over 350 oersted, are obtained by an alloy containing 13–32% chromium, 5–20%, cobalt, no more than 0.005 to 0.03% carbon, and the balance iron.

The addition of 0.05 to 3% titanium, vanadium, molybdenum or tungsten provides the alloy with an improved workability.

Preferred alloy compositions are as follows:

Best mode (1) (with Ti and V): 24 to 27% chromium, 9 to 12% cobalt, 0.005% to 0.02% carbon, 0.4 to 1.0% titanium, 0.5 to 1.0% vanadium, and the balance iron.

Resultant coercive force: over 400 oersted.

Best mode (2) (with Mo and W): 27 to 30% chromium, 15 to 18% cobalt, 0.005 to 0.02% carbon, 0.5 to 2.5% molybdenum, 0.5 to 2.5% tungsten, and the balance iron.

Resultant coercive force: over 500 oersted.

First Embodiment

The first embodiments of the printer printing machine of the present invention will be explained with reference to the drawings.

Reference numeral (1) denotes a wire-shaped magnetic recording medium. The magnetic recording medium is formed by the way that an alloy material containing iron, chrome and cobalt is processed to be wire-shaped by the well-known method such as rolling and drawing, thereafter an N pole and an S pole are alternately magnetized.

Figure 2:
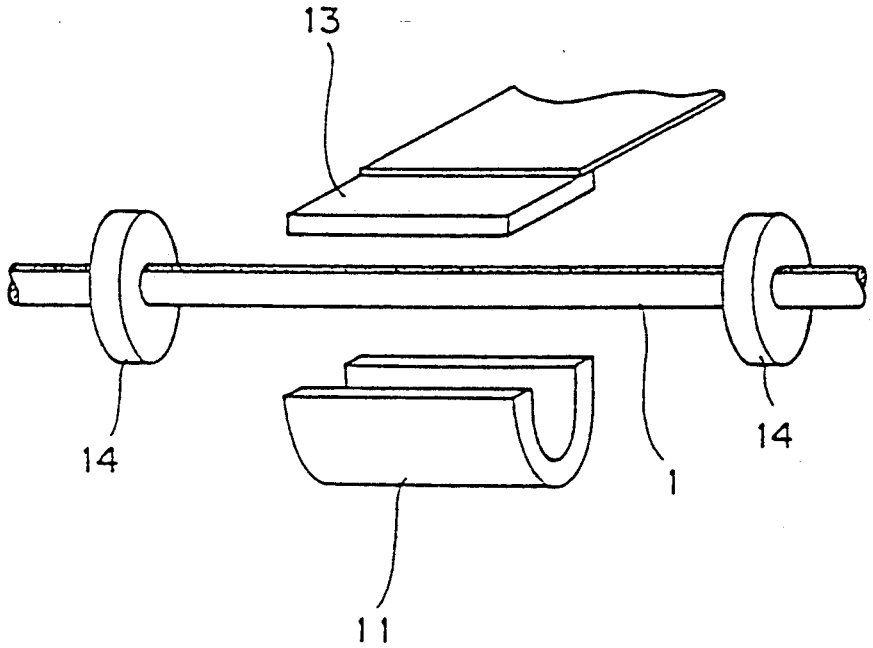
FIG. 2 is an exploded perspective view of a gap holding part of an embodiment of the present invention.

Reference (2) denotes a gap holding part having a magnetic head. The above part may be structured as specifically shown in FIG. 2. In FIG. 2, a magnetic element mount (11) whose cross section is U-shaped is mounted on the wire-shaped magnetic recording medium (1). A magnetic sensor (13) is fixed onto the magnetic element mount (11) so as to contact mount (11) and to form a magnetic head which completely surrounds the magnetic recording medium (1). Further, a bearing (14), which has a hole into which a round bar-like magnetic recording medium is inserted in its central portion, is fixed to both ends of the magnetic element mount (11). Since the magnetic element mount (11) slides along the rod-shaped magnetic recording medium (1), serving as an axis, together with the magnetic sensor (13), the rod-shaped magnetic recording medium (1) is arranged to be floated in the hollow.

Reference numeral (3) denotes a printing head. In the printer printing machine, various types of printing heads such as an ink jet type, a dot impact type, a laser printer, and a thermal transferring type may be used.

Reference numeral (4) denotes a slide guide shaft for guiding a printing head. In the present invention, the guide mechanism other than one shown in the drawing may be used.

Second Embodiment

Figure 3:
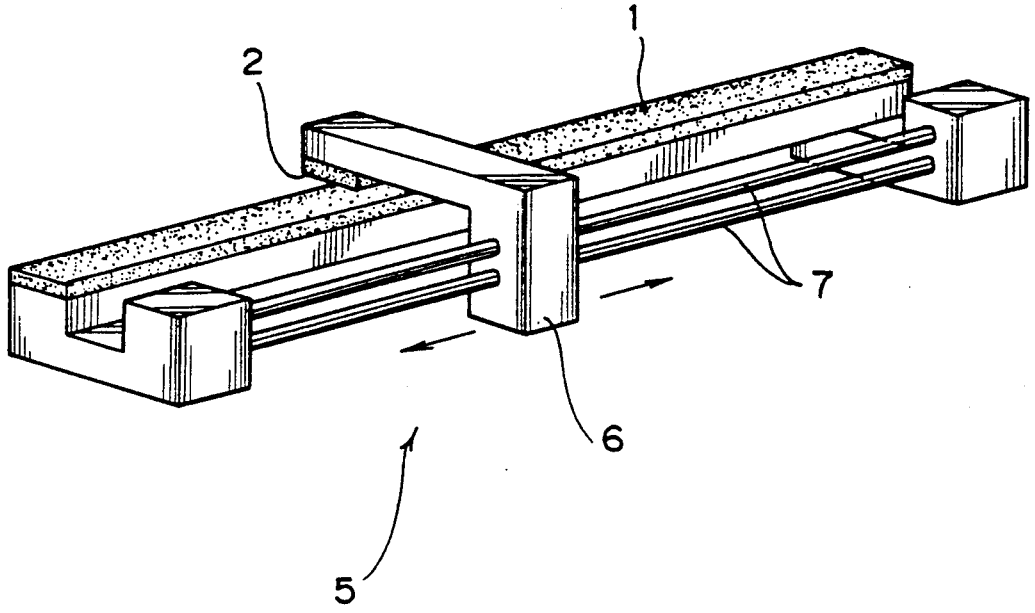
FIG. 3 is a perspective view of a gap holding mechanism of an embodiment of the present invention.

FIG. 3 shows a gap holding mechanism (5) of an embodiment of the present invention. In this mechanism, the magnetic head (22) is supported by a magnetic head support (6) so as to face the magnetic recording medium (21). The magnetic head support (6) is guided by a support guide (7). As a result, the gap between the magnetic head (22) and the magnetic recording medium (21) can be maintained to be a suitable value.

The magnetic recording medium is formed by a method such that an alloy material containing iron, chrome and cobalt is processed to a bar-shape with a rectangular cross section by the well-known methods such as rolling and drawing, thereafter an N pole and an S pole are alternately magnetized over the surface of the bar.

The magnetic head uses a magneto-resistance effect element, and is fixed to a printing head of a printer printing machine. The printer printing machine uses a printing head such as an ink jet type, a dot impact type, and a thermal transferring type. The printing mechanism moves relative to a printing paper.

Since the magnetic head fixed to the printing head moves relative to the printing paper, the magnetic recording medium is fixed to a body of the printer printing machine.

As shown in FIG. 3, the magnetic detecting surface of the magnetic head (22) fixed to the printing head and the magnetized surface of the magnetic recording medium (21) face each other, and are controlled through the gap holding mechanism (5) so as to maintain the gap having a constant distance.

According to the above structure, the magnetic recording medium (1), (21) and the magnetic head (2) can be used in a mechanically non-contact state and no sliding resistance state.

As is obvious from the above explanation, the printer printing machine of the present invention brings about the following effects.

① As compared with the conventional printer printing machine using an optical linear encoder, the printer printing machine of the present invention is economical.

② The printer printing machine of the present invention is not influenced by a contaminated environment such as a printer ink paper fragments, and high reliability can be obtained, and the time for maintenance can be reduced.

What is claimed is:

1. A printing machine for printing at printing positions along a line, and for performing a positional control by a linear encoder, the printing machine comprising:

a linear encoder memory having a line-shaped magnetic recording medium formed of an alloy consisting essentially of iron, chromium and cobalt, said alloy not containing more than 0.03 weight % carbon, said linear encoder memory extending parallel along a line of printing positions; and detecting means, coupled to said magnetic recording medium and being movable relative to said magnetic recording medium for detecting a magnetic record on said magnetic recording medium, said detecting means comprising a magnetic head which includes a magnetic sensor element and a supporting mount, said supporting mount being disposed opposite the magnetic sensor element and being in contact with the magnetic sensor element, said supporting mount and magnetic sensor element together forming means for surrounding said line-shaped magnetic recording medium and for transversely and slidably receiving said line-shaped magnetic recording medium between said supporting mount and said magnetic sensor element.

2. The printing machine according to claim 1, wherein said line-shaped magnetic recording medium is a member having a circular cross section.

3. The printing machine according to claim 1, wherein said line-shaped magnetic recording medium is a member having a cross section in which a magnetic recording surface of said magnetic head and an opposite surface of said recording medium are parallel to each other.

4. The printing machine according to claim 1, wherein the alloy contains no more than 0.02 weight % carbon.

5. The printing machine according to claim 1, wherein said line-shaped magnetic recording medium and said magnetic head move relative to and slidably with each other.

6. The printing machine according to claim 1, wherein said line-shaped magnetic recording medium is a member having a truncated circular cross section.

7. The printing machine according to claim 1, wherein said magnetic recording medium comprises 13 to 32 weight % chromium, 5 to 20 weight % cobalt, and the balance iron.

8. The printing machine according to claim 7, wherein said magnetic recording medium further comprises 0.05 to 3 weight % of at least one element selected from the group consisting of titanium, vanadium, molybdenum and tungsten.

9. The printing machine according to claim 7, wherein the alloy consists of chromium, cobalt, iron and no more than 0.003 weight % carbon.

10. The printing machine according to claim 7, wherein the alloy consists essentially of no more than 0.005 to 0.03 weight % carbon.

11. A printing machine for printing at printing positions along a line, and for performing a positional control by linear encoder, the printing machine comprising:

a linear encoder memory having a line-shaped magnetic recording medium formed of an alloy consisting essentially of iron, chromium, cobalt, no more than 0.03 weight % of carbon, and 0.05 to 3 weight % of at least one element selected from the group consisting of titanium, vanadium, molybdenum and tungsten, said linear encoder memory extending parallel along a line of printing positions; and detecting means, coupled to said magnetic recording medium and being movable relative to said magnetic recording medium for detecting a magnetic record on said magnetic recording medium, said detecting means comprising a magnetic head which includes a magnetic sensor element and a supporting mount, said supporting mount being disposed opposite the magnetic sensor element and being in contact with the magnetic sensor element, said supporting mount and magnetic sensor element together forming means for surrounding said line-shaped magnetic recording medium and for transversely and slidably receiving said line-shaped magnetic recording medium between said supporting mount and said magnetic sensor element.

12. The printing machine according to claim 11, wherein the alloy consists essentially of 13 to 32 weight % chromium, 5 to 20 weight % cobalt, no more than 0.005 to 0.03% carbon, 0.05 to 3 weight % titanium, vanadium, molybdenum or tungsten and the balance iron.

13. The printing machine according to claim 11, wherein the alloy consists of iron, chromium, cobalt, no more than 0.03 weight % carbon and 0.05 to 3 weight % of at least one element selected from the group consisting of titanium, vanadium, molybdenum and tungsten.

14. The printing machine according to claim 11, wherein the alloy contains no more than 0.02 weight % carbon.

15. A printing machine for printing at printing positions along a line, and for performing a positional control by linear encoder, the printing machine comprising:

a linear encoder memory having a line-shaped magnetic recording medium formed of an alloy consisting essentially of 24 to 27 weight % chromium, 9 to 12 weight % cobalt, 0.005 to 0.02 weight % carbon, 0.4 to 1.0 weight % titanium, 0.5 to 1.0 weight % vanadium and the balance iron, said linear encoder memory extending parallel along a line of printing positions; and detecting means, coupled to said magnetic recording medium and being movable relative to said magnetic recording medium for detecting a magnetic record on said magnetic recording medium, said detecting means comprising a magnetic head which includes a magnetic sensor element and a supporting mount, said supporting mount being disposed opposite the magnetic sensor element and being in contact with the magnetic sensor element, said supporting mount and magnetic sensor element together forming means for surrounding said line-shaped magnetic recording medium and for transversely and slidably receiving said line-shaped magnetic recording medium between said supporting mount and said magnetic sensor element.

16. A printing machine for printing at printing positions along a line, and for performing a positional control by linear encoder, the printing machine comprising:

a linear encoder memory having a line-shaped magnetic recording medium formed of an alloy consisting essentially of 27 to 30 weight % chromium, 15 to 18 weight % cobalt, 0.005 to 0.02 weight % carbon, 0.5 to 2.5 weight % molybdenum, 0.5 to 2.5 weight % tungsten and the remainder iron, said linear encoder memory extending parallel along a line of printing positions; and detecting means, coupled to said magnetic recording medium and being movable relative to said magnetic recording medium for detecting a magnetic record on said magnetic recording medium, said detecting means comprising a magnetic head which includes a magnetic sensor element and a supporting mount, said supporting mount being disposed opposite the magnetic sensor element and being in contact with the magnetic sensor element, said supporting mount and magnetic sensor element together forming means for surrounding said line-shaped magnetic recording medium and for transversely and slidably receiving said line-shaped magnetic recording medium between said supporting mount and said magnetic sensor element.

* * * * *